US010600356B1

(12) United States Patent
Lee et al.

(10) Patent No.: US 10,600,356 B1
(45) Date of Patent: Mar. 24, 2020

(54) DISPLAY SYSTEMS AND METHODS INVOLVING TIME-MODULATED CURRENT CONTROL

(71) Applicant: a.u. Vista Inc., Milpitas, CA (US)

(72) Inventors: Ming-Hsien Lee, Hsinchu (TW); Fang-Chen Luo, Milpitas, CA (US)

(73) Assignee: A.U. VISTA INC., Milpitas, CA (US)

( * ) Notice: Subject to any disclaimer, the term of this patent is extended or adjusted under 35 U.S.C. 154(b) by 27 days.

(21) Appl. No.: 16/190,342

(22) Filed: Nov. 14, 2018

(51) Int. Cl.
*G09G 3/32* (2016.01)

(52) U.S. Cl.
CPC ..... *G09G 3/32* (2013.01); *G09G 2300/0426* (2013.01); *G09G 2300/0819* (2013.01); *G09G 2320/064* (2013.01); *G09G 2330/021* (2013.01)

(58) Field of Classification Search
None
See application file for complete search history.

(56) References Cited

U.S. PATENT DOCUMENTS

2004/0246202 A1* 12/2004 Yamashita ..... G09G 3/3258 345/30
2006/0132053 A1* 6/2006 Cho ..... G09G 3/3233 315/169.3
2016/0351130 A1* 12/2016 Kikuchi ..... H03M 1/34

FOREIGN PATENT DOCUMENTS

CN 107481662 A 12/2017

* cited by examiner

*Primary Examiner* — Christopher J Kohlman
(74) *Attorney, Agent, or Firm* — McClure, Qualey & Rodack, LLP

(57) ABSTRACT

A representative display system includes: a pixel array having a plurality of pixels, gate lines, and data lines; a first of the pixels having a first TFT, a second TFT, a storage capacitor, and an LED; the first TFT having a first gate electrode, a first source electrode, and a first drain electrode, the first gate electrode coupled to a first of the gate lines, the first source electrode and the first drain electrode coupled between a first of the data lines and a first terminal of the storage capacitor; the second TFT having a second gate electrode, a second source electrode, and a second drain electrode, the second gate electrode coupled between the first TFT and the storage capacitor; the LED coupled to the second TFT; wherein the storage capacitor is configured to store a data voltage corresponding to a data signal, coupled to the first terminal, from the first of the data lines during an on-time of the first TFT; and wherein the LED is controllable to emit light at a brightness corresponding to duration of a driving current flowing through the LED, the driving current being provided to the LED in response to the data voltage from the storage capacitor and a PWM signal, coupled to a second terminal of the storage capacitor terminal and configured as a sawtooth waveform, being provided to the second gate electrode.

21 Claims, 8 Drawing Sheets

DISPLAY SYSTEMS AND METHODS INVOLVING TIME-MODULATED CURRENT CONTROL

BACKGROUND

Technical Field

The disclosure generally relates to display technology, especially that which is focused on emissive LED display technology.

Description of the Related Art

Various display technologies (e.g., liquid crystal displays (LCDs)) are widely used in displays for electronic devices, such as laptops, smart phones, digital cameras, billboard-type displays, and high-definition televisions. In addition, other display technologies, such as organic light-emitting diodes (OLEDs) and electronic paper displays (EPDs), are gaining in public attention.

LCD panels may be configured as disclosed, for example, in Wu et al., U.S. Pat. No. 6,956,631, which is assigned to AU Optronics Corp., the parent company of the assignee of the current application, and hereby incorporated by reference in its entirety. As disclosed in Wu et al. FIG. 1, the LCD panel may comprise a top polarizer, a lower polarizer, a liquid crystal cell, and a back light. Light from the back light passes through the lower polarizer, through the liquid crystal cell, and then through the top polarizer. As further disclosed in Wu et al. FIG. 1, the liquid crystal cell may comprise a lower glass substrate and an upper substrate containing color filters. A plurality of pixels comprising thin film transistor (TFT) devices may be formed in an array on the glass substrate, and a liquid crystal compound may be filled into the space between the glass substrate and the color filter forming a layer of liquid crystal material.

Still, the structure of TFTs in displays may be various. For instance, The TFTs, gate and data lines, and pixel electrodes may be formed in a multilayer structure such as that shown in FIGS. 1 and 2E of Lai et al., U.S. Pat. No. 7,170,092 and in its division U.S. Pat. No. 7,507,612, both of which are assigned to AU Optronics Corp., the parent company of the assignee of the current application, and both of which are hereby incorporated by reference in their entireties. The multilayer structure may comprise a first conducting layer, a first insulating layer, a semiconductor layer, a doped semiconductor layer, and a second conducting layer disposed in sequence on the substrate. It may further comprise a second insulating layer and a pixel electrode disposed on the second insulating layer. The first conducting layer may comprise at least one of a gate line or a gate electrode. The doped semiconductor layer may comprise a source and a drain. The second conducting layer may comprise a source electrode and a drain electrode. The multilayer structure may be formed using a series of wet and dry etching processes, for example as disclosed in Lai et al. FIGS. 2A-2D.

Additional techniques for forming TFTs are disclosed in Chen, U.S. Pat. No. 7,652,285, which is assigned to AU Optronics Corp., the parent company of the assignee of the current application, and hereby incorporated by reference in its entirety. As disclosed in Chen, to form the channel of the TFT, the second metal layer is etched in order to open a portion of the second metal layer over the gate electrode and to separate the source region and drain region. This etching can be performed in multiple ways, including the back-channel etching process disclosed for example in Chen FIGS. 2A-2E and the etch stop process disclosed for example in Chen FIGS. 5A-5D and 6. Chen discloses that TFT leakage currents may be reduced by adding a spacer layer formed at the sidewalls of the conductive doped amorphous silicon layer, isolating the conductive amorphous silicon layer from the insulating layer. Chen discloses that this spacer layer can be formed by oxidizing the exposed surface of the conductive amorphous silicon layer after the etch of the second metal layer is performed. Chen discloses that this surface may be oxidized by a number of different techniques, including oxygen plasma ashing, or the use of ozone plasma in the presence of carbon tetrafluoride and sulfur hexafluoride gases As explained in Sawasaki et al., U.S. Pat. No. 7,557,895, which is assigned to AU Optronics Corp., the parent company of the assignee of the current application, and hereby incorporated by reference in its entirety, the thickness of the liquid crystal layer typically must be uniformly controlled, in order to avoid unevenness in brightness across the LCD panel. As disclosed in Sawasaki et al., the required uniformity may be achieved by disposing a plurality of pillar spacers between the TFT substrate and the color filter substrate. As further disclosed in Sawasaki et al., the pillar spacers may be formed with different heights, such that some spacers have a height that is greater than the gap between the substrates and other spacers have a height that is less than the gap between the substrates. This configuration may permit the spacing between the substrates to vary with temperature changes but also prevent excessive deformation when forces are applied to the panel.

Sawasaki et al. further discloses a method for assembling the substrates with the liquid crystal material between them. This method comprises steps of preparing the two substrates, coating a sealing material on the circumference of the outer periphery of one of the pair of substrates, dropping an appropriate volume of liquid crystal on one of the pair of substrates, and filling in the liquid crystal between the pair of substrates by attaching the pair of substrates in a vacuum followed by returning the attached pair of substrates to atmospheric pressure.

In LCD panels, the semiconductor material making up the TFT channel may be amorphous silicon. However, as disclosed in Chen, U.S. Pat. No. 6,818,967, which is assigned to AU Optronics Corp., the parent company of the assignee of the current application, and hereby incorporated by reference in its entirety, poly-silicon channel TFTs offer advantages over amorphous silicon TFTs, including lower power and greater electron migration rates. Poly-silicon may be formed by converting amorphous silicon to poly-silicon via a laser crystallization or laser annealing technique. Use of the laser permits fabrication to occur at temperatures below 600° C., and the fabricating technique is thus called low temperature poly-silicon (LTPS). As disclosed in Chen, the re-crystallization process of LTPS results in the formation of mounds on the surface of the poly-silicon layer, and these mounds impact the current characteristics of the LTPS TFT. Chen discloses a method to reduce the size of the LTPS surface mounds, by performing a first anneal treatment, then performing a surface etching treatment, for example using a solution of hydrofluoric acid, and then performing a second anneal treatment. The resulting LTPS surface has mounds with a height/width ratio of less than 0.2. A gate isolation layer, gate, dielectric layer, and source and drain metal layers can then be deposited above the LTPS layer to form a complete LTPS TFT.

As disclosed in Sun et al., U.S. Pat. No. 8,115,209, which is assigned to AU Optronics Corp., the parent company of the assignee of the current application, and hereby incorporated by reference in its entirety, a disadvantage of LTPS TFTs compared to amorphous silicon TFTs is a relatively large leakage current during TFT turn off. Use of multiple gates reduces leakage current, and Sun et al. discloses a number of different multi-gate structures for a polycrystalline silicon TFT, including those shown in Sun et al. FIGS. 2A-2B and 3-6.

Recently, emerging display technologies such as AMOLED, microLED or AMLED for use as the backlight of a TFT-LCD all require a TFT matrix circuit to control the emissive brightness of the emissive display, which is typically an emissive LED display. Typically, the brightness of the emissive LED is controlled by the amplitude of the current passing through a control TFT matrix circuit, which is sensitive to the threshold of the control TFT. Also, a significant amount of power tends to be consumed by the control TFT.

Therefore, there is a perceived need for improvements in power consumption and/or sensitivity to TFT threshold voltage variation.

SUMMARY

Display systems and methods involving time-modulated current control are provided. In one embodiment, a display system comprises: a pixel array having a plurality of pixels, a plurality of gate lines, and a plurality of data lines; a first of the plurality of pixels having a first thin film transistor (TFT), a second TFT, a storage capacitor, and a light emitting diode (LED); the first TFT having a first gate electrode, a first source electrode, and a first drain electrode, the first gate electrode being electrically coupled to a first of the plurality of gate lines, the first source electrode and the first drain electrode being electrically coupled between a first of the plurality of data lines and a first terminal of the storage capacitor; the second TFT having a second gate electrode, a second source electrode, and a second drain electrode, the second gate electrode being electrically coupled between the first TFT and the storage capacitor; the LED being electrically coupled to the second TFT; wherein the storage capacitor is configured to store a data voltage corresponding to a data signal, coupled to the first terminal, from the first of the plurality of data lines during an on-time of the first TFT; and wherein the LED is controllable to emit light at a brightness corresponding to duration of a driving current flowing through the LED, the driving current being provided to the LED in response to the data voltage from the storage capacitor and a pulse width modulated (PWM) signal, coupled to a second terminal of the storage capacitor terminal and configured as a sawtooth waveform, being provided to the second gate electrode.

In some embodiments, the display system further comprises: a third TFT coupled to the PWM signal; and a fourth TFT coupled to a reference signal.

In some embodiments, the first TFT, second TFT, and fourth TFT are a same type of TFT; and the third TFT is a different type of TFT In some embodiments, each of the first TFT, second TFT, and fourth TFT is an N-type TFT; and the third TFT is a P-type TFT.

In some embodiments, each of the first TFT, second TFT, and fourth TFT is a P-type TFT; and the third TFT is an N-type TFT.

In some embodiments, the third TFT has a third gate electrode, a third source electrode, and a third drain electrode; and the third source electrode and the third drain electrode are electrically coupled to the second terminal of the storage capacitor.

In some embodiments, the fourth TFT has a fourth gate electrode, a fourth source electrode, and a fourth drain electrode; and the fourth source electrode and the fourth drain are electrically coupled to the second terminal of the storage capacitor.

In some embodiments, the fourth source electrode and the fourth drain electrode are electrically coupled between the second terminal of the storage capacitor and third TFT.

In one embodiment, a method of controlling a pixel array comprises: providing a pixel array having plurality of pixels, a plurality of gate lines, and a plurality of data lines; a first of the plurality of pixels having a first thin film transistor (TFT), a second TFT, a storage capacitor, and a light emitting diode (LED); the first TFT having a first gate electrode, a first source electrode, and a first drain electrode, the first gate electrode being electrically coupled to a first of the plurality of gate lines, the first source electrode and the first drain electrode being electrically coupled between a first of the plurality of data lines and a first terminal of the storage capacitor; the second TFT having a second gate electrode, a second source electrode, and a second drain electrode, the second gate electrode being electrically coupled between the first TFT and the storage capacitor; the LED being electrically coupled to the second TFT; storing, with the storage capacitor, a data voltage corresponding to a data signal from the first of the plurality of data lines during an on-time of the first TFT; and controlling the LED to emit light at a brightness corresponding to the duration of a driving current flowing through the LED, the driving current being provided to the LED in response to the data voltage on the storage capacitor and a pulse width modulated (PWM) signal, configured as a sawtooth waveform, corresponding to a threshold voltage of the second TFT.

In some embodiments, the controlling the LED to emit light comprises controlling the LED to begin emitting light only a time at which a voltage level, which corresponds to the data voltage and the PWM signal combined, exceeds the threshold voltage of the driving TFT.

In some embodiments, the controlling the LED to emit light comprises providing a reference signal coupled to the storage capacitor.

In some embodiments, the reference signal is a fixed voltage signal.

In some embodiments, the reference signal is a shifted waveform corresponding to the PWM signal.

In some embodiments, the on-time of the first transistor is controlled by a scan signal coupled to the gate electrode of the first transistor; and a lowest voltage level of the scan signal is lower than a lowest voltage level of the data signal.

In one embodiment, a pixel circuit comprises: a light emitting diode (LED) and a storage capacitor; a first transistor having a gate electrode, a source electrode, and a drain electrode, the gate electrode being electrically coupled to a gate line, the source electrode and the drain electrode being electrically coupled between a data line and a first terminal of the storage capacitor; a second transistor having a gate electrode, a source electrode, and a drain electrode, the gate electrode of the driving transistor being electrically coupled between the first transistor and the first terminal of the storage capacitor; the LED being electrically coupled between the second transistor and a first fixed voltage source (VDD); wherein the storage capacitor is configured to store a data voltage corresponding to a data signal, coupled to the first terminal, from the data line during an on-time of the first transistor; and wherein the LED is controllable to emit light at a brightness corresponding to duration of a driving current flowing through the LED, the driving current being provided to the LED in response to the data voltage from the storage capacitor and a pulse width modulated (PWM) signal, coupled to a second terminal of the storage capacitor and configured as a sawtooth waveform, being provided to the gate electrode of the second transistor.

In some embodiments, the pixel circuit further comprises: a third transistor coupled to the PWM signal; and a fourth transistor coupled to a reference signal.

In some embodiments, the reference signal is a fixed voltage signal.

In some embodiments, the reference signal is a shifted waveform corresponding to the PWM signal.

In some embodiments, the PWM signal exhibits a cut-off at a predetermined voltage level.

In some embodiments, the LED is controlled to begin emitting light only a time at which an integration of a voltage level of the PWM signal and a voltage level of the data voltage from the storage capacitor corresponds to a threshold voltage of the second transistor.

In some embodiments, the on-time of the first transistor does not occur at a time associated with a falling voltage level of the PWM signal.

In some embodiments, the on-time of the first transistor is controlled by a scan signal coupled to the gate electrode of the first transistor; and a lowest voltage level of the scan signal is lower than a lowest voltage level of the data signal.

Other objects, features, and/or advantages will become apparent from the following detailed description of the preferred but non-limiting embodiments. The following description is made with reference to the accompanying drawings.

DETAILED DESCRIPTION

For ease in explanation, the following discussion describes several embodiments of systems and methods involving time-modulated current control. It is to be understood that the invention is not limited in its application to the details of the particular arrangements shown since the invention is capable of other embodiments. Also, the terminology used herein is for the purpose of description and not of limitation.

In this regard, as will be described in greater detail below, various systems and methods control the brightness of an emissive LED by controlling the width (i.e., the time duration) of a driving current flowing through the LED. In some embodiments, the ON period of an associated driving (or control) TFT is controlled by a data voltage, which is stored in a storage capacitor and transferred through a switch TFT when the switch TFT is turned ON during a line time. By controlling the brightness of the LED in each pixel by the width of driving current, potentially significant reductions in power consumption and/or reduced sensitivity of TFT threshold voltage variation may be achieved in some embodiments.

Figure 1:
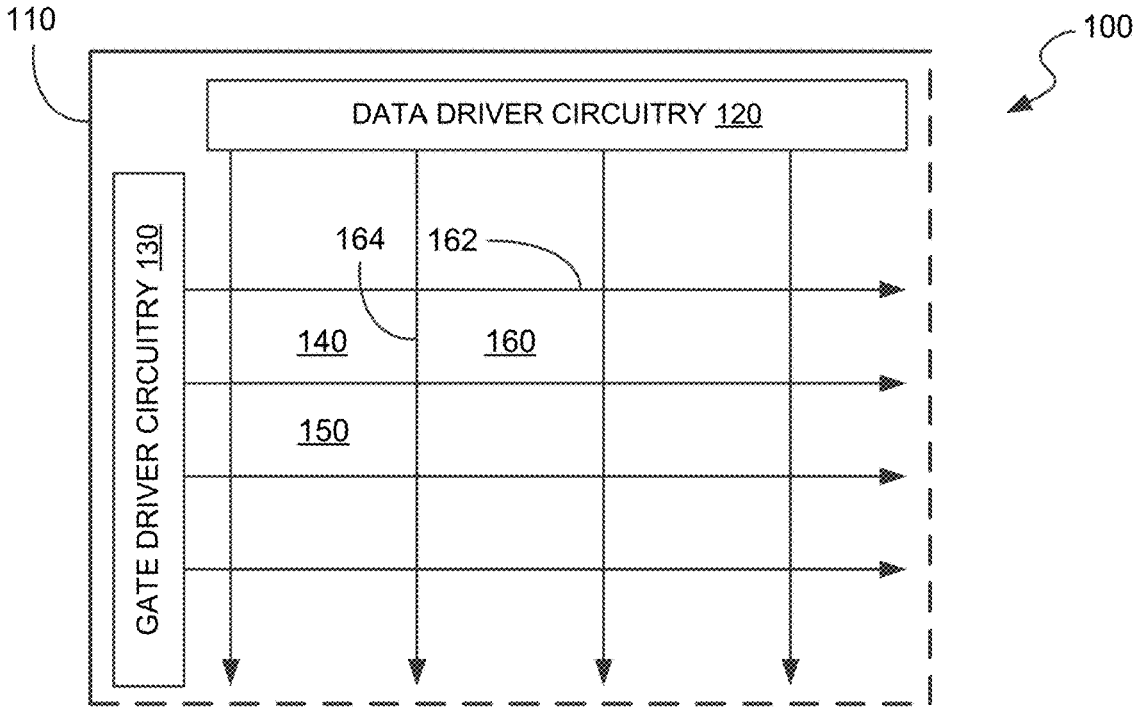
FIG. 1 is a schematic diagram of a portion of an embodiment of a display system.

Preferred embodiments will now be described with reference to the drawings. In particular, FIG. 1 depicts a portion of an embodiment of a display system 100, which includes a pixel array 110 that may be used in various implementations. Pixel array 110 incorporates data driver circuitry 120 and gate driver circuitry 130. It should be noted that circuits and functions of various embodiments may be implemented by hardware, software or a combination of hardware and software such as microcontrollers, application-specific integrated circuits (ASIC) and programmable microcontrollers, as well as by circuits that may be implemented by TFT array processes, such as gate driver circuitry 130 on array (GOA).

As shown in FIG. 1, pixel array 110 incorporates a plurality of pixels (typically thousands of pixels, e.g., pixels 140, 150, 160), which are arranged in a two-dimensional array comprising a plurality of rows and columns. For ease in illustration, only a few pixels are illustrated in FIG. 1. Each pixel (or pixel circuit) is coupled to a gate line and a data line. By way of example, pixel 160 is electrically coupled to a gate line 162 and a data line 164. Data driver circuitry 120 and gate driver circuitry 130 control the voltage applied to the respective gate and data lines to individually address each pixel for controlling emission of light from one or more LEDs associated with the pixel.

Figure 2:
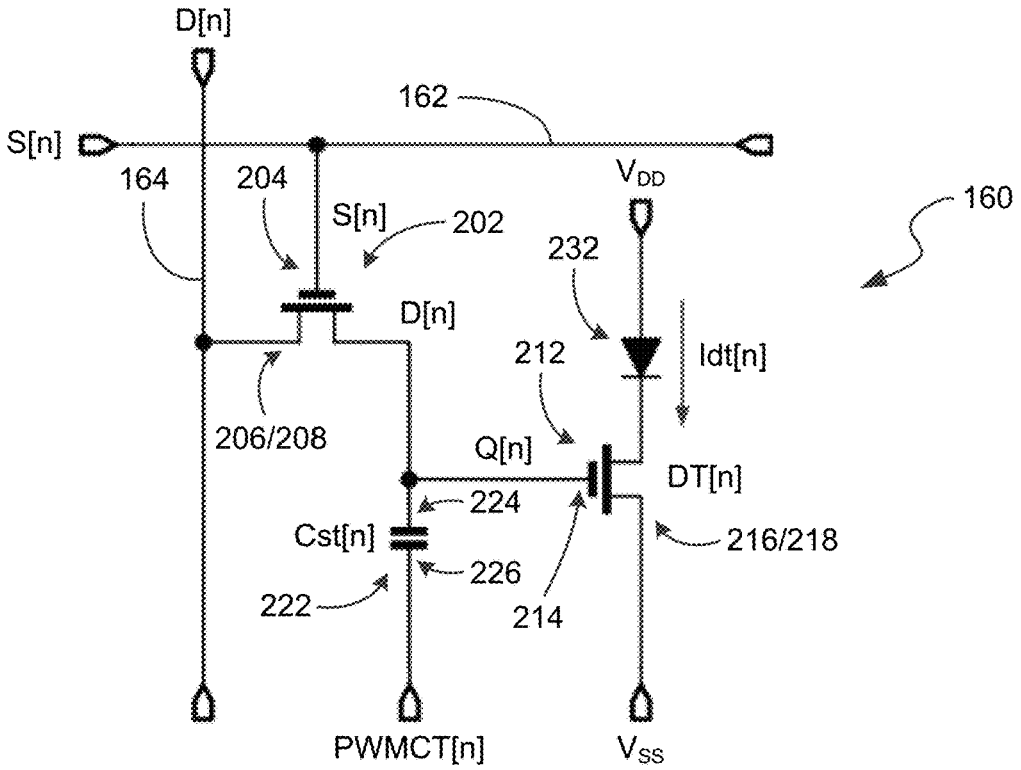
FIG. 2 is a schematic diagram of an embodiment of a pixel circuit.

FIG. 2 shows pixel 160 in greater detail. Specifically, pixel 160 incorporates a first TFT 202, a second (driving) TFT 212, a storage capacitor 222, and an LED 232. TFT 202 includes a gate electrode 204, which is electrically coupled to gate line 162 for receiving a gate signal S[n], as well as source and drain electrodes 206, 208, which are electrically coupled between data line 164 and a first terminal 224 of storage capacitor 222. TFT 212 is a driving transistor of the pixel 160, TFT 212 includes a gate electrode 214, as well as source and drain electrodes 216, 218. Gate electrode 214 is electrically coupled to TFT 202 and storage capacitor 222. LED 232 is electrically coupled to TFT 212 between a high potential ($V_{DD}$) and a low potential ($V_{SS}$), e.g., GND, or fixed potential voltage sources.

In operation, storage capacitor 222 is configured to store, during an ON-time of TFT 202, a data voltage ($V_{D[n]}$) corresponding to a data signal D[n] from data line 164. A driving current (Idt[n]) is provided to LED 232 in response to data voltage ($V_{D[n]}$), which is combined with and a pulse width modulated (PWM) signal ($V_{PWMCT[n]}$), being provided to gate electrode 214 of TFT 212. In this regard, PWM signal ($V_{PWMCT[n]}$) is coupled to a second terminal 226 of storage capacitor 222. The data voltage ($V_{D[n]}$) and the PWM signal ($V_{PWMCT[n]}$) are combined and provided to gate electrode 214 of TFT 212, thus controlling LED 232 to emit light at a brightness corresponding to integration (i.e., a width) of the driving current (Idt[n]) flowing through LED 232. So configured, driving current (Idt[n]) is controlled by a time-modulated pulse at point Q[n], which corresponds to gate electrode 214 of TFT 212. The voltage at Q[n] is established by the inputs of the data voltage ($V_{D[n]}$) at a scanning time and the PWM signal ($V_{PWMCT[n]}$) so that, when the integration of the voltage levels of these signals corresponds to (e.g., exceeds) a threshold voltage of the second TFT, the driving current is provided to the LED. The level voltage at point D[n] (i.e., the data voltage ($V_{D[n]}$)) is a voltage stored in storage capacitor 222 when TFT 204 is turned ON at a line time on gate line 162. Notably, in some embodiments, the PWM signal is a sawtooth-like waveform with a cut-off below a threshold voltage.

Figure 3:
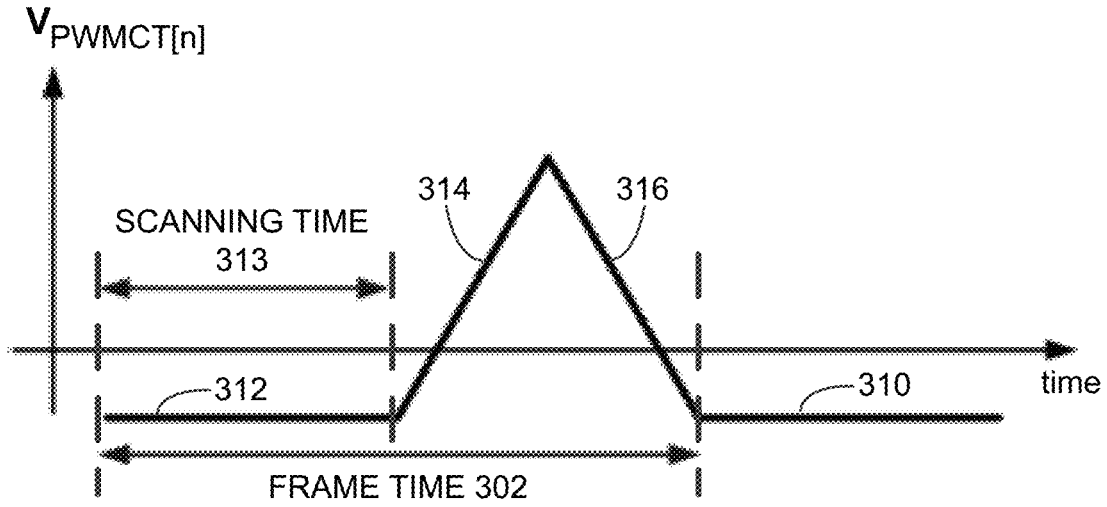
FIG. 3 is a graph depicting voltage versus time for an embodiment of a pulse width modulated signal.

FIG. 3 is a graph depicting PWM signal voltage ($V_{PWMCT[n]}$) versus time for an embodiment of a PWM signal that may be used in the pixel circuit of FIG. 2, for example. As shown in FIG. 3, during a frame time 302, PWM signal 310 exhibits a plane portion 312 (which is present during a scanning time 313) followed by a rising portion 314 and a falling portion 316. Note that the plane portion 312 may have a negative fixed potential voltage, the rising portion 314 and falling portion 316 (which may exhibit corresponding slopes) cross a cut-off designated by the time-axis (x-axis). In some embodiments, the cut-off may be a predetermined voltage threshold, such as greater or equal to a threshold voltage of the driving TFT (e.g., TFT 212).

Figure 4:
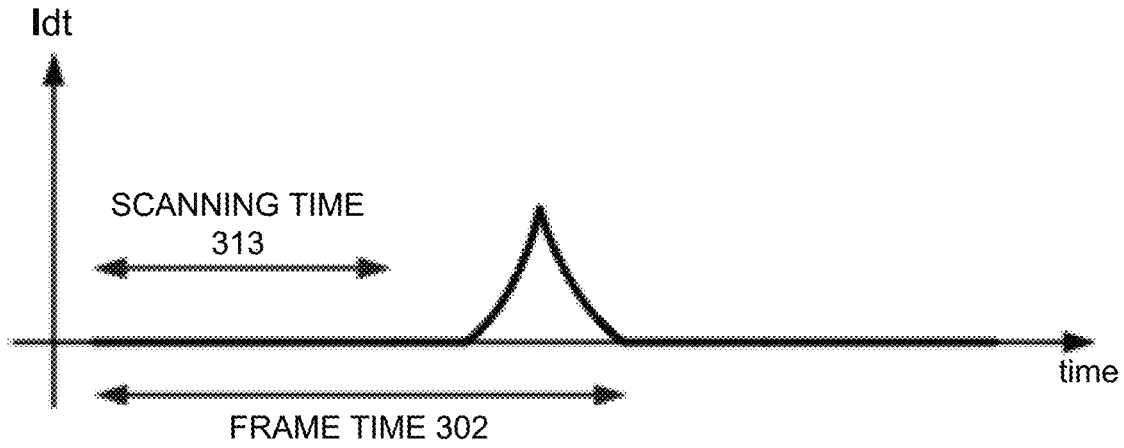
FIG. 4 is a graph depicting current versus time for an embodiment of a driving current configured to control brightness of an LED of a pixel circuit.

As shown in FIG. 4, which depicts current (Idt) versus time for an embodiment of a driving current that is configured to control brightness of an LED of a pixel circuit, such as pixel circuit 160. The brightness of the associated LED (e.g., LED 232) is controlled by the integration of current Idt.

With continued reference to FIGS. 3 and 4, it is noted that these figures are aligned vertically in time (x-axis). Gate voltage of DT (214) is integrated by Vdata and VPWMCT. When 214 is greater than the threshold voltage of DT TFT (212), the driving current starts to flow through TFT 212 (shown as Idt[n]). The driving current Idt[n] and VG will follow formulas of TFT. In the embodiment depicted in FIG. 4, the illumination intensity of LED 232 is proportional to Idt. Thus, the illumination duration (ON-time) corresponds to (e.g., will be the same as) the width of the driving current, and the brightness will be the integration of illumination versus time. In short, the brightness is related to the width and the quantity of Idt.

Figure 5:
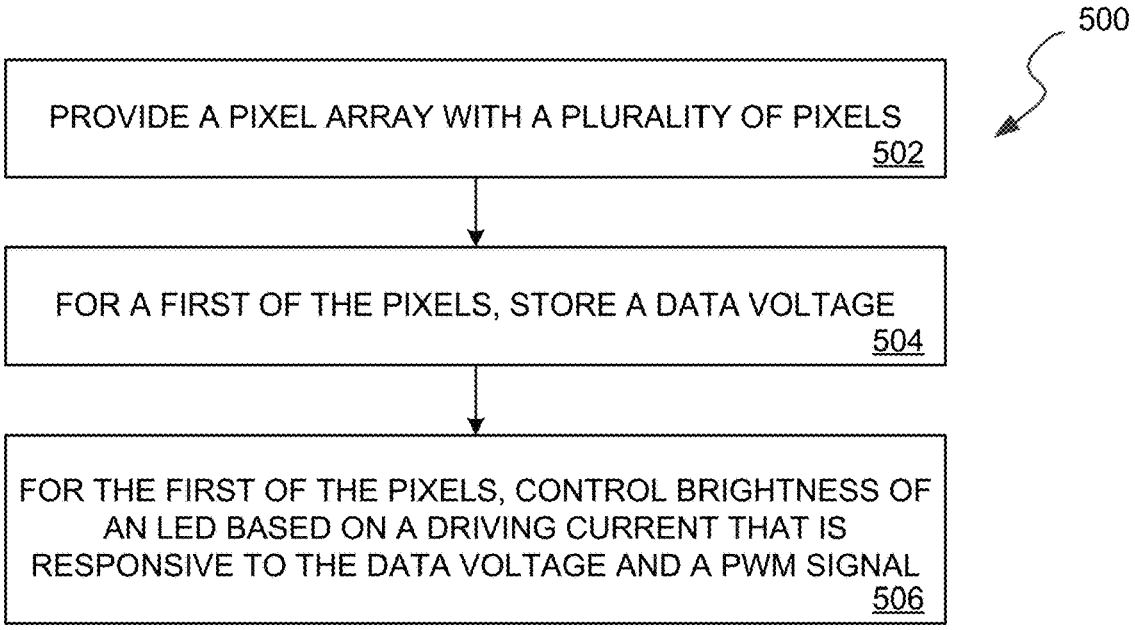
FIG. 5 is a flowchart depicting an embodiment of a method of controlling a pixel array.

FIG. 5 is a flowchart depicting an embodiment of a method of controlling a pixel array, such as pixel array 110 of FIG. 1. As shown in FIG. 5, method 500 may be construed as beginning at block 502, in which a pixel array with a plurality of pixels, a plurality of gate lines, and a plurality of data lines is provided. In some embodiments, a first of the plurality of pixels includes first and second TFTs, a storage capacitor, and an LED. The first TFT includes a first gate electrode, a first source electrode, and a first drain electrode, with the first gate electrode being electrically coupled to a first of the plurality of gate lines, and the first source electrode and the first drain electrode being electrically coupled between a first of the plurality of data lines and a first terminal of the storage capacitor. The second TFT includes a second gate electrode, a second source electrode, and a second drain electrode, with the second gate electrode being electrically coupled between the first TFT and the storage capacitor. The LED is electrically coupled to the second TFT.

In block 504, for the first of the plurality of pixels, a data voltage is stored. In particular, a data voltage corresponding to a data signal from the first of the plurality of data lines is stored by the storage capacitor during an ON-time of the first TFT. In some embodiments, the ON-time of the first TFT is controlled by a scan signal coupled to the gate electrode of the first TFT. Further, in some embodiments, a lowest voltage level of the scan signal is lower than a lowest voltage level of the data signal. Additionally or alternatively, in some embodiments, such as in that of FIG. 2, a reference signal (which may be in addition to the data signal) is coupled to the storage capacitor.

In block 506, for the first of the plurality of pixels, brightness of the LED is controlled based on a driving current that is responsive to the data voltage and a PWM signal. Specifically, the LED is controlled to emit light at a brightness corresponding to integration of a driving current flowing through the LED. The driving current is provided to the LED in response to the data voltage from the storage capacitor and a pulse width modulated (PWM) signal, which may be configured as a sawtooth waveform. In some embodiments, controlling the LED involves controlling the LED to begin emitting light only a time at which a voltage level of the PWM signal exceeds a voltage level of the data voltage from the storage capacitor. In some embodiments, the reference signal (mentioned in block 504) may be a fixed voltage signal or a shifted waveform corresponding to the PWM signal.

Figure 6:
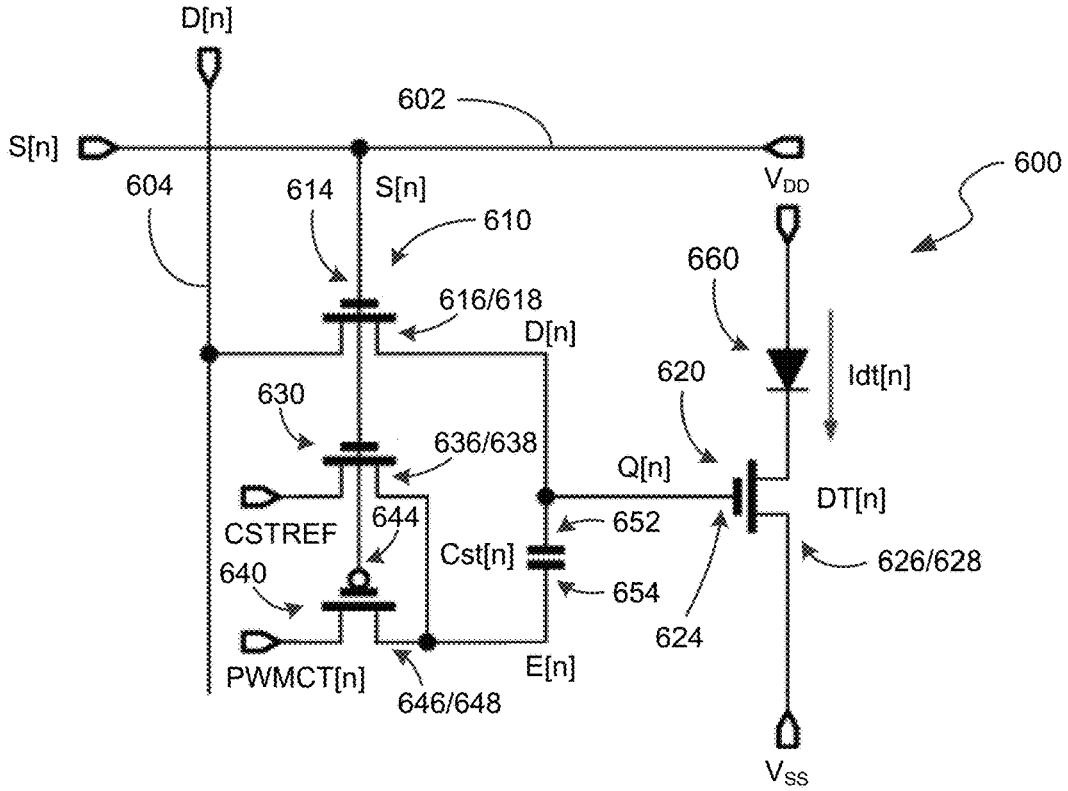
FIG. 6 is a schematic diagram of another embodiment of a pixel circuit.

FIG. 6 is a schematic diagram of another embodiment of a pixel circuit. As shown in FIG. 6, pixel circuit (pixel) 600 incorporates a first TFT 610, a second (driving) TFT 620, a third TFT 630, a fourth TFT 640, a storage capacitor 650, and an LED 660. TFT 610 includes a gate electrode 614, which is electrically coupled to gate line 602, as well as source and drain electrodes 616, 618, which are electrically coupled between data line 604 and a first terminal 652 of storage capacitor 650 in order to receive data signal D[n] to the first terminal 652 of storage capacitor 650 during the scanning time. TFT 620 includes a gate electrode 624, as well as source and drain electrodes 626, 628. Gate electrode 624 is electrically coupled between TFT 610 and storage capacitor 650. LED 660 is electrically coupled to TFT 620 between a high potential ($V_{DD}$) and a low potential ($V_{SS}$), e.g., GND.

TFT 630 includes a gate electrode 634, which is electrically coupled to gate line 602, as well as source and drain electrodes 636, 638, which are electrically coupled to a second terminal 654 of storage capacitor 650. TFT 640 includes a gate electrode 644, which is electrically coupled to gate line 602, as well as source and drain electrodes 646, 648, which also are coupled to second terminal 654 of storage capacitor 650. In this embodiment, source and drain electrodes 646, 648 are electrically coupled between second terminal 654 of storage capacitor 650 and TFT 630. Notably, TFT 630 is coupled to a PWM signal (PWMCT[n]) and TFT 640 is coupled to a reference signal (CSTREF). Additionally, it should be noted that, in some embodiments, the TFTs 610, 620 and 640 are the same type of TFT, and TFT 630 is a different type of TFT. Thus, in some embodiments, TFTs 610, 620 and 640 are N-type TFTs, and TFT 630 is a P-type TFT, while in other embodiments, TFTs 610, 620 and 640 are P-type TFTs, and TFT 630 is an N-type TFT.

In a particular embodiment, TFT 630 is an N-type TFT and TFT 640 is a P-type TFT. In this embodiment, the gate electrodes 634, 644 of TFTs 630, 640 are electrically coupled to gate line 602; as one electrode of each of TFT 630, 640 are coupled to second terminal 654 of storage capacitor 650. TFT 630 and TFT 640 may not turn on during the same period. During the scanning time, TFT 630 receives the reference signal (CSTREF) at the second terminal 654 of storage capacitor 650; after the scanning time, TFT 640 receives the PWM signal (PWMCT[n]) at the second terminal 654 of storage capacitor 650.

The reference signal (CSTREF) may be a constant zero voltage, a fixed voltage, or a shifted waveform of the PWM signal (PWMCT[n]). If the reference signal (CSTREF) is a fixed voltage, a fixed grey level (e.g., L255) of the data signals D[n] at the voltage of the point Q[n] will be different for pixels VQ[1] and VQ[1080], because the waveforms of PWMCT[1] and PWMCT[1080] are different. The results to the brightness of different pixels D[1] and D[1080] will be slightly different. If the reference signal (CSTREF) is the shifted waveform of the PWM signal (PWMCT[n]), the brightness performance of different pixels will be physically the same, which may improve display quality of the display system 100.

In operation, when the gate signal (S[n]) provided on gate line 602 turns ON, TFTs 610 and 630 are turned ON and TFT 640 turns OFF. This enables the data voltage on data line 604 to be transferred to terminal 652 of storage capacitor 650 and the reference voltage of CSTREF to be transferred to terminal 654 of storage capacitor 650. When the gate signal is turned OFF (and becomes negative), TFTs 610 and 630 are turned OFF and TFT 640 turns ON. This enables the voltage of PWM signal (PWMCT[n]) to be transferred to terminal 654 of storage capacitor 650, which boosts the voltage of terminal 652 of storage capacitor 650. This results in a boost in voltage at Q[n] (i.e., at gate electrode 624 of driving TFT 620) owing to the voltage combination of the data voltage and the voltage PWMCT[n] for the off period until the gate signal S[n] is turned on again. Notably, driving TFT 620 will turn ON and driving current (Idt[n]) will flow only when voltage at Q[n] is above the threshold voltage of driving TFT 620.

Figure 7A:
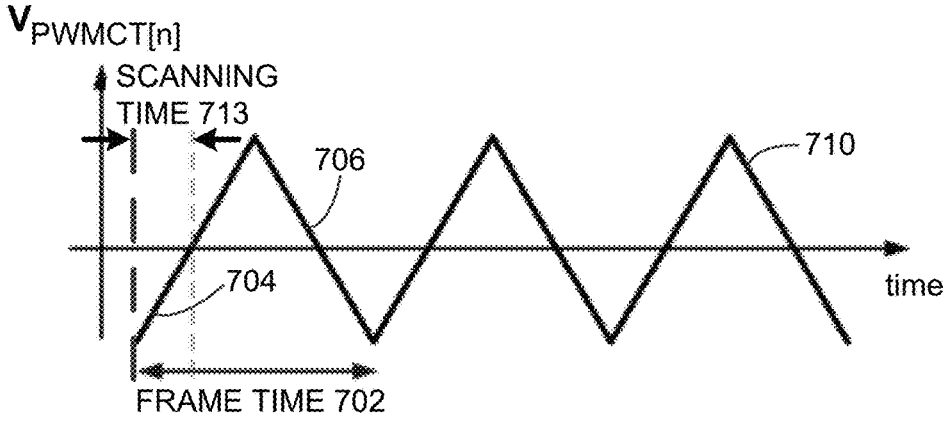
FIG. 7A is a graph depicting voltage versus time for an embodiment of a pulse width modulated signal.

FIG. 7A is a graph depicting PWM signal voltage ($V_{PWMCT[n]}$) versus time for an embodiment of a PWM signal that may be used in the pixel circuit of FIG. 6, for example. In particular, during a frame time 702, PWM signal 710 (which is configured as a sawtooth-like waveform) exhibits a rising portion 704 and a falling portion 706, both of which cross a cut-off voltage designated by the time-axis (x-axis). In some embodiments, the cut-off may be a predetermined voltage threshold.

Figure 7B:
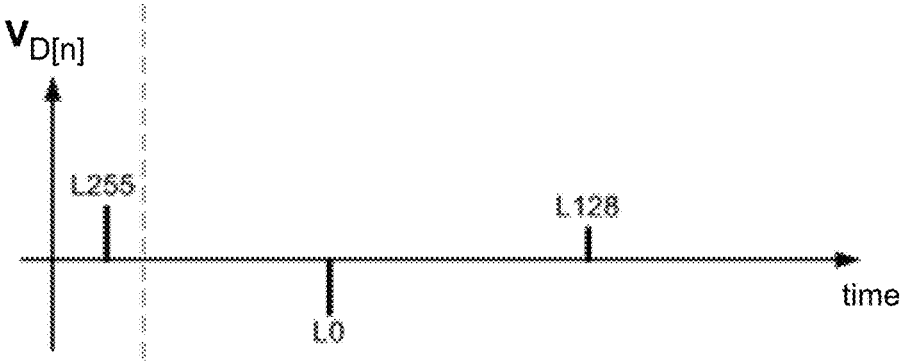
FIG. 7B is a graph depicting voltage versus time for an embodiment of a data signal.
Figure 7C:
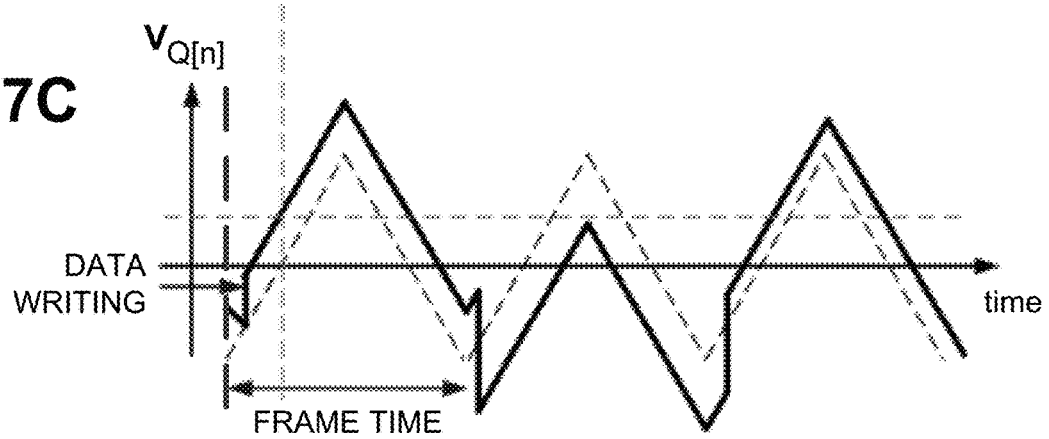
FIG. 7C is a graph depicting voltage versus time for an embodiment of a driving signal.
Figure 7D:
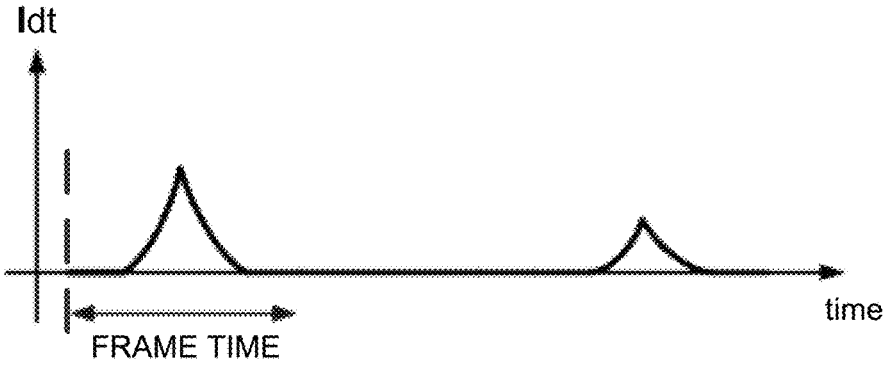
FIG. 7D is a graph depicting current versus time for an embodiment of a signal configured to control brightness of an LED of a pixel circuit.

FIG. 7B is a graph depicting voltage versus time for an embodiment of a data signal (Data[n]). The data signal corresponds to gray levels represented by various voltages. By way of example, LO indicates the lowest voltage of the data signal, whereas L255 represents the highest voltage. Notably, the voltage of the data signal ($V_{Data[n]}$) is written to Cst[n] at the scanning time 713, and then coupled by the PWM signal PWMCT[n]. As shown in FIG. 7C, terminal 654 of storage capacitor 650 is reset to the reference signal CSTREF during the programming/scanning stage at the scanning time 713. The brightness of the LED 660 at different frame times 702 is controlled by the integration of current Idt[n] as shown in FIG. 7D. Notably, the ON-time of TFT 610 does not occur at a time associated with a falling voltage level of the PWM signal. In this regard, the ON-time of TFT 610 is controlled by a scan signal coupled to gate electrode 614. In some embodiments, a lowest voltage level of the scan signal is lower than a lowest voltage level of the data signal.

Please refer to FIGS. 7A-7D and FIG. 6, in which FIGS. 7A-7D depict operation of the pixel circuit in the FIG. 6 in continuous frame times. During the first frame time 702, a beginning interval of the rising portion of the PWM signal PWMCT[n] is the scanning time 713. During the scanning time 713, TFT 610 receives the data signal D[n] L255 as described in FIG. 7B and TFT 630 receives the reference signal CSTREF at the terminal 654 of the storage capacitor 650 to reset the terminal 654 to the reference signal CSTREF voltage potential as a fixed voltage (dotted line as depicted in FIG. 7C). The voltage of the point Q[n] during the scanning time 713 is in accordance with the data signal D[n]. After the scanning time 713, TFT 640 turns on and receives PWM signal PWMCT[n] at the terminal 654 of the storage capacitor 650, with the voltage of point Q[n] being in accordance with the PWM signal PWMCT[n] as depicted in FIG. 7C. FIG. 7D depicts the current Idt[n] of the driving TFT 620.

Figure 8A:
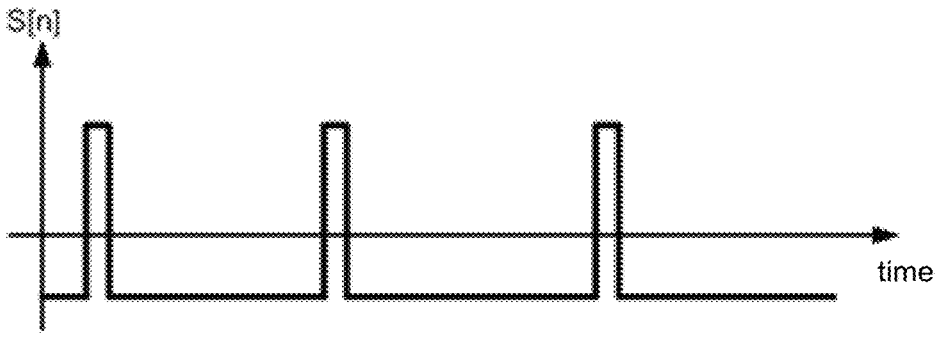
FIGS. 8A-8C are graphs depicting gate ON/OFF times for TFT gates of an embodiment of a pixel circuit.
Figure 8B:
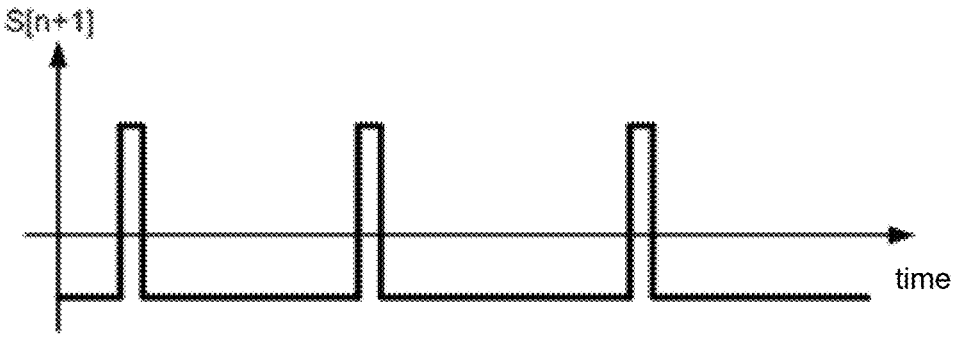
Figure 8C:
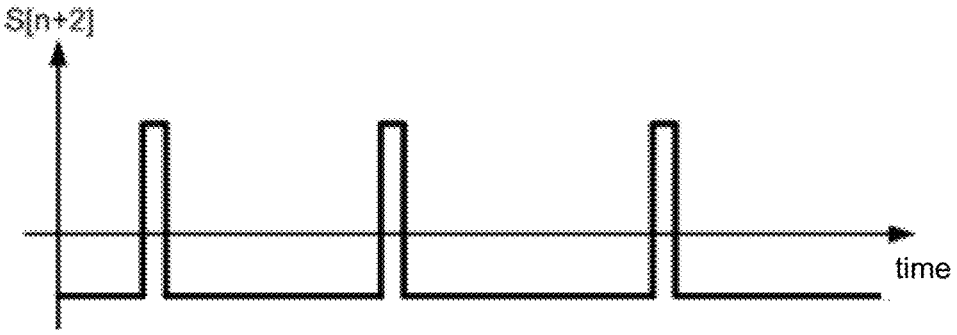

FIGS. 8A-8C are graphs depicting gate ON/OFF times for TFT gates of an embodiment of a pixel circuit. During scanning time, each TFT gate was turned ON/OFF, respectively. In some embodiments, the TFT gates may either be switched by an associated gate driver IC or gate driver on array (GOA) circuit. As mentioned previously, data is written during the gate signal S[n] ON period. The gate signal S[n] has a low potential voltage, which may be lower than zero voltage in order to ensure driving TFT 620 turns off during the gate signal S[n] ON period.

Figure 9A:
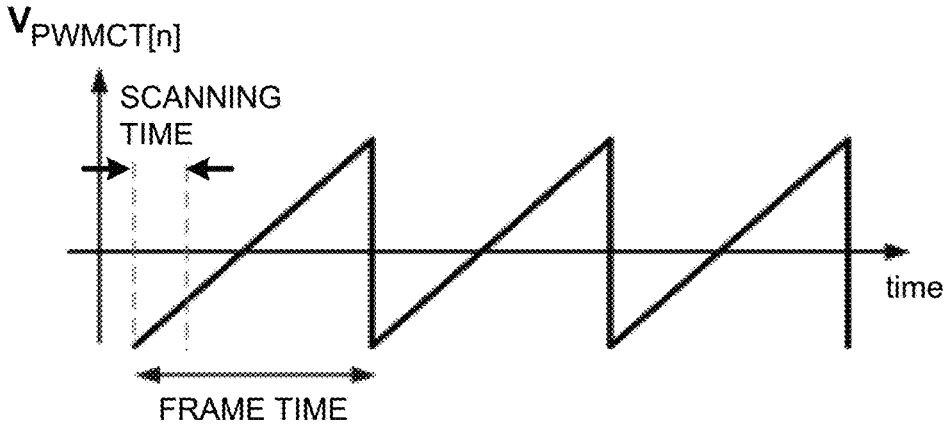
FIG. 9A is a graph depicting voltage versus time for an embodiment of a pulse width modulated signal.

FIG. 9A is a graph depicting PWM signal voltage ($V_{PWMCT[n]}$) versus time for another embodiment of a PWM signal that may be used in the pixel circuit, such as circuit 600 of FIG. 6, for example. In particular, during a frame time 902, PWM signal 910 (which is configured as a sawtooth-like waveform) exhibits a rising portion 904 and a falling portion 906, both of which cross a cut-off voltage designated by the time-axis (x-axis). Note that, in contrast to the embodiment of FIG. 7A, falling portion 906 exhibits a steeper slope.

Figure 9B:
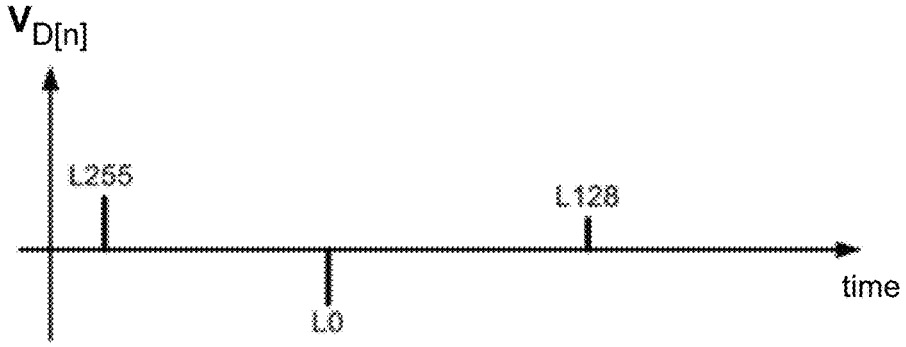
FIG. 9B is a graph depicting voltage versus time for an embodiment of a data signal.
Figure 9C:
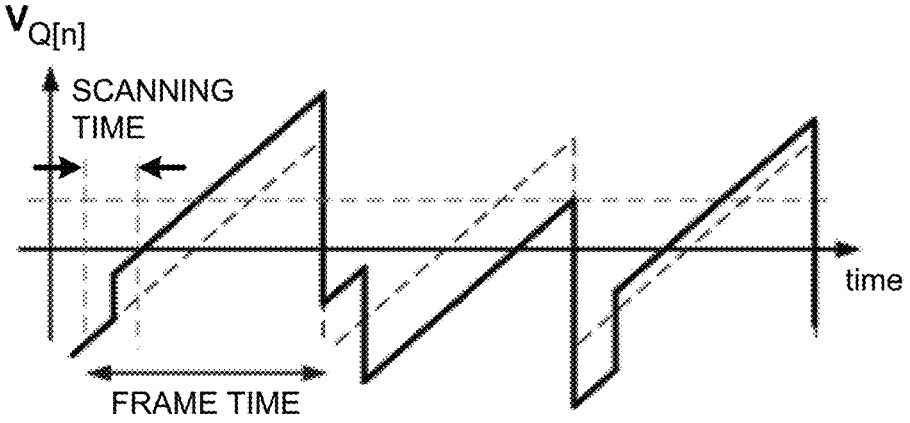
FIG. 9C is a graph depicting voltage versus time for an embodiment of a driving signal.
Figure 9D:
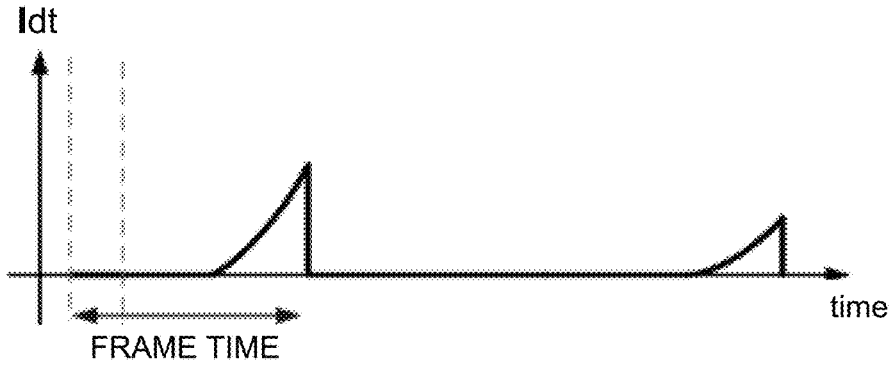
FIG. 9D is a graph depicting current versus time for an embodiment of a signal configured to control brightness of an LED of a pixel circuit.

Relatedly, FIG. 9B is a graph depicting voltage versus time for an embodiment of a data signal that may be associated with PWM signal 910, with FIG. 9C depicting a resultant voltage over time for a corresponding driving signal. As shown in FIG. 9D, brightness of an associated LED is controlled by integration of the driving current Idt[n].

Please refer to FIG. 9A-9D and FIG. 6 together. The PWMCT signal is a ramp pulse as depicted in FIG. 9A and the reference signal is a fixed voltage as depicted in FIG. 9C. Thus, the current Idt[n] of the driving TFT 620 has the waveform as shown in FIG. 9D, which may physically correspond to an emission period of the LED 660. Notably, the emission period is in accordance with the threshold voltage of the LED 660 and the threshold voltage of the driving TFT 620.

Figure 10A:
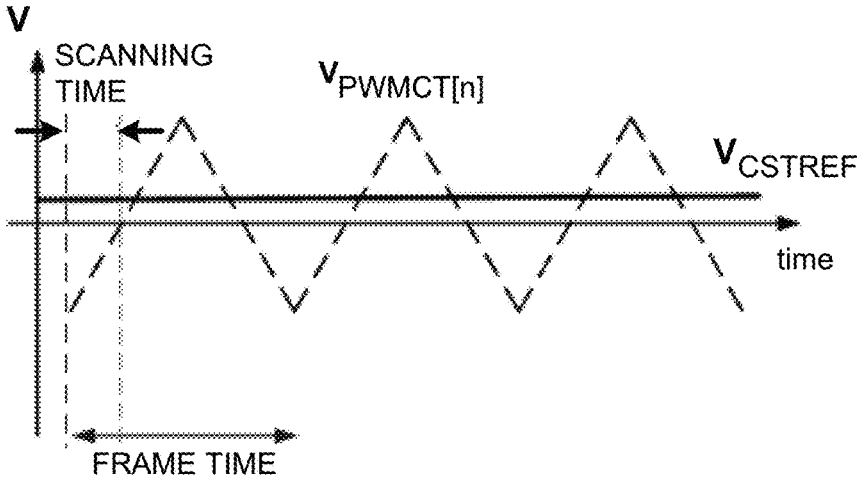
FIGS. 10A-10D are graphs depicting embodiments of pulse width modulated signals and associated reference signals.
Figure 10B:
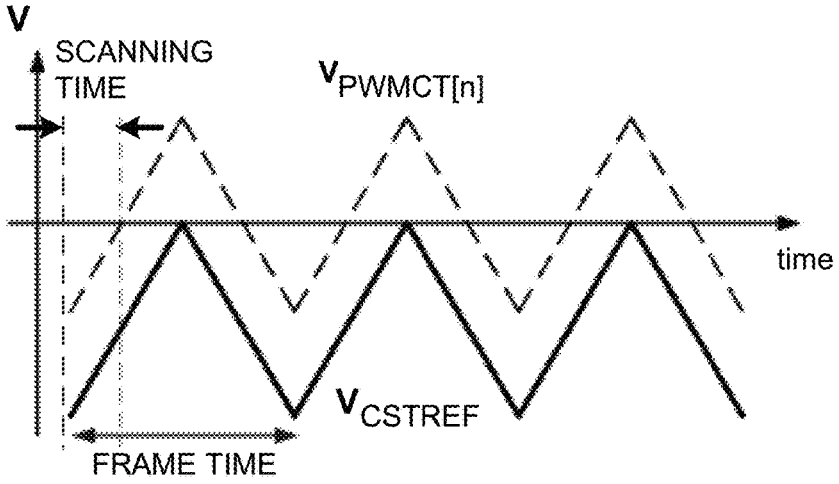
Figure 10C:
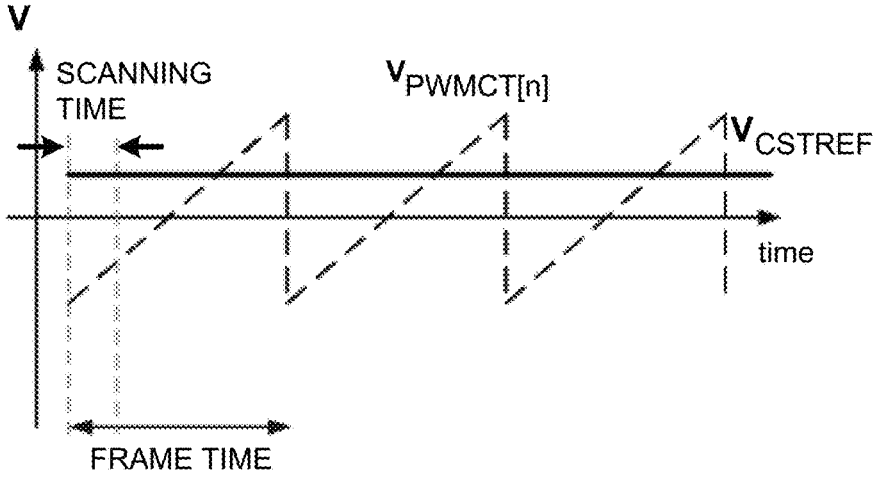
Figure 10D:
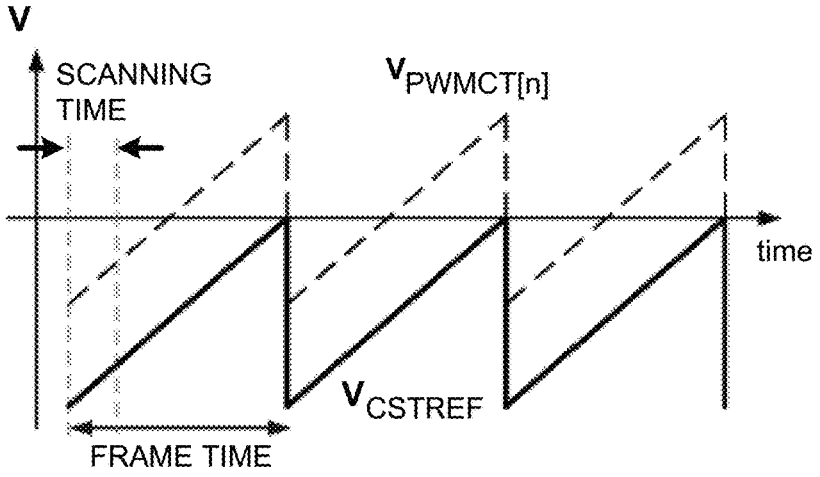

FIGS. 10A-10D are graphs depicting various embodiments of PWM signals (PWMCT) and associated reference signals (CSTREF). As shown in FIGS. 10A and 10C, PWMCT may exhibit a sawtooth-like waveform while CSTREF exhibits a fixed voltage (e.g., GND). In contrast, as shown in FIGS. 10B and 10D, PWMCT may exhibit a sawtooth-like waveform while CSTREF exhibits a shifted waveform corresponding to the PWM signal.

Please refer to FIGS. 10A-10D, in which the dashed line depicts the PWM signal (PWMCT[n]), and the solid line depicts the reference signal (CSTREF). Notably, reference signal (CSTREF) may be a constant zero voltage, a fixed voltage, or a shifted waveform of the PWM signal (PWMCT [n]). If the reference signal (CSTREF) is a fixed voltage, a fixed grey level (e.g., L255) of the data signals D[n] at the voltage of the point Q[n] will be different for pixels VQ[1] and VQ[1080], because the waveforms of PWMCT[1] and PWMCT[1080] are different. The results to the brightness of different pixels D[1] and D[1080] will be slightly different. If the reference signal (CSTREF) is the shifted waveform of the PWM signal (PWMCT[n]), the brightness performance of different pixels will be physically the same, which may improve display quality of the display system 100.

The embodiments described above are illustrative of the invention and it will be appreciated that various permutations of these embodiments may be implemented consistent with the scope and spirit of the invention.

What is claimed is:

1. A display system comprising:

a pixel array having a plurality of pixels, a plurality of gate lines, and a plurality of data lines;

a first of the plurality of pixels having a first thin film transistor (TFT), a second TFT, a storage capacitor, and a light emitting diode (LED);

the first TFT having a first gate electrode, a first source electrode, and a first drain electrode, the first gate electrode being electrically coupled to a first of the plurality of gate lines, the first source electrode and the first drain electrode being electrically coupled between a first of the plurality of data lines and a first terminal of the storage capacitor;

the second TFT having a second gate electrode, a second source electrode, and a second drain electrode, the second gate electrode being electrically coupled between the first TFT and the storage capacitor;

the LED being electrically coupled to the second TFT;

wherein the storage capacitor is configured to store a data voltage corresponding to a data signal, coupled to the first terminal, from the first of the plurality of data lines during an on-time of the first TFT; and wherein the LED is controllable to emit light at a brightness corresponding to duration of a driving current flowing through the LED, the driving current being provided to the LED in response to the data voltage from the storage capacitor and a pulse width modulated (PWM) signal, coupled to a second terminal of the storage capacitor terminal and configured as a sawtooth waveform, being provided to the second gate electrode.

2. The display system according to claim 1, further comprising:

a third TFT coupled to the PWM signal; and a fourth TFT coupled to a reference signal.

3. The display system according to claim 2, wherein:

the first TFT, second TFT, and fourth TFT are a same type of TFT; and the third TFT is a different type of TFT.

4. The display system according to claim 3, wherein:

the first TFT, second TFT, and fourth TFT are a N-type TFTs; and the third TFT is a P-type TFT.

5. The display system according to claim 2, wherein:

the third TFT has a third gate electrode, a third source electrode, and a third drain electrode; and the third source electrode and the third drain electrode are electrically coupled to the second terminal of the storage capacitor.

6. The display system according to claim 5, wherein:

the fourth TFT has a fourth gate electrode, a fourth source electrode, and a fourth drain electrode; and the fourth source electrode and the fourth drain are electrically coupled to the second terminal of the storage capacitor.

7. The display system according to claim 6, wherein the fourth source electrode and the fourth drain electrode are electrically coupled to the second terminal of the storage capacitor and third TFT.

8. A method of controlling a pixel array, the method comprising:

providing a pixel array having plurality of pixels, a plurality of gate lines, and a plurality of data lines; a first of the plurality of pixels having a first thin film transistor (TFT), a second TFT, a storage capacitor, and a light emitting diode (LED); the first TFT having a first gate electrode, a first source electrode, and a first drain electrode, the first gate electrode being electrically coupled to a first of the plurality of gate lines, the first source electrode and the first drain electrode being electrically coupled between a first of the plurality of data lines and a first terminal of the storage capacitor; the second TFT having a second gate electrode, a second source electrode, and a second drain electrode, the second gate electrode being electrically coupled to the first TFT and the storage capacitor; the LED being electrically coupled to the second TFT;

storing, with the storage capacitor, a data voltage corresponding to a data signal from the first of the plurality of data lines during an on-time of the first TFT; and controlling the LED to emit light at a brightness corresponding to the duration of a driving current flowing through the LED, the driving current being provided to the LED in response to the data voltage on the storage capacitor and a pulse width modulated (PWM) signal, configured as a sawtooth waveform, corresponding to a threshold voltage of the second TFT.

9. The method according to claim 8, wherein the controlling the LED to emit light comprises controlling the LED to begin emitting light only a time at which a voltage level, which corresponds to the data voltage and the PWM signal combined, exceeds the threshold voltage of the driving TFT.

10. The method according to claim 8, wherein the controlling the LED to emit light comprises providing a reference signal coupled to the storage capacitor.

11. The method according to claim 10, wherein the reference signal is a fixed voltage signal.

12. The method according to claim 10, wherein the reference signal is a shifted waveform corresponding to the PWM signal.

13. The method according to claim 8, wherein:

the on-time of the first TFT is controlled by a scan signal coupled to the gate electrode of the first TFT; and a lowest voltage level of the scan signal is lower than a lowest voltage level of the data signal.

14. A pixel circuit, comprising:

a light emitting diode (LED) and a storage capacitor;

a first transistor having a gate electrode, a source electrode, and a drain electrode, the gate electrode being electrically coupled to a gate line, the source electrode and the drain electrode being electrically coupled between a data line and a first terminal of the storage capacitor;

a second transistor having a gate electrode, a source electrode, and a drain electrode, the gate electrode of the driving transistor being electrically coupled to the first transistor and the first terminal of the storage capacitor;

the LED being electrically coupled between the second transistor and a first fixed voltage source (VDD);

wherein the storage capacitor is configured to store a data voltage corresponding to a data signal, coupled to the first terminal of the storage capacitor, from the data line during an on-time of the first transistor; and wherein the LED is controllable to emit light at a brightness corresponding to duration of a driving current flowing through the LED, the driving current being provided to the LED in response to the data voltage from the storage capacitor and a pulse width modulated (PWM) signal, coupled to a second terminal of the storage capacitor and configured as a sawtooth waveform, being provided to the gate electrode of the second transistor.

15. The pixel circuit according to claim 14, further comprising:

a third transistor coupled to the PWM signal; and a fourth transistor coupled to a reference signal.

16. The pixel circuit according to claim 15, wherein the reference signal is a fixed voltage signal.

17. The pixel circuit according to claim 15, wherein the reference signal is a shifted waveform corresponding to the PWM signal.

18. The pixel circuit according to claim 14, wherein the PWM signal exhibits a cut-off at a predetermined voltage level.

19. The pixel circuit according to claim 14, wherein the LED is controlled to begin emitting light only a time at which an integration of a voltage level of the PWM signal and a voltage level of the data voltage from the storage capacitor corresponds to a threshold voltage of the second transistor.

20. The pixel circuit according to claim 14, wherein the on-time of the first transistor does not occur at a time associated with a falling voltage level of the PWM signal.

21. The pixel circuit according to claim 14, wherein:

the on-time of the first transistor is controlled by a scan signal coupled to the gate electrode of the first transistor; and a lowest voltage level of the scan signal is lower than a lowest voltage level of the data signal.

* * * * *